US008430405B2

(12) United States Patent
Gagner et al.

(10) Patent No.: US 8,430,405 B2
(45) Date of Patent: Apr. 30, 2013

(54) MULTI-PROJECTOR GAMING TABLE

(75) Inventors: Mark B. Gagner, West Chicago, IL (US); Timothy C. Loose, Chicago, IL (US); James M. Rasmussen, Chicago, IL (US); Alfred Thomas, Las Vegas, NV (US)

(73) Assignee: WMS Gaming, Inc., Waukegan, IL (US)

( * ) Notice: Subject to any disclaimer, the term of this patent is extended or adjusted under 35 U.S.C. 154(b) by 362 days.

(21) Appl. No.: 12/945,885

(22) Filed: Nov. 14, 2010

(65) Prior Publication Data

US 2011/0115158 A1 May 19, 2011

Related U.S. Application Data

(60) Provisional application No. 61/261,316, filed on Nov. 14, 2009.

(51) Int. Cl.
*A63F 3/00* (2006.01)
*G09G 5/00* (2006.01)

(52) U.S. Cl.
USPC ..... 273/274; 273/287; 273/309; 463/34; 345/9

(58) Field of Classification Search ..... 273/274, 273/284, 287, 309; 463/1, 34; 345/7, 9, 345/158, 418
See application file for complete search history.

(56) References Cited

U.S. PATENT DOCUMENTS

| | | | | |
|---|---|---|---|---|
| 7,465,230 | B2 * | 12/2008 | LeMay et al. | 463/32 |
| 7,483,015 | B2 * | 1/2009 | Sato | 345/156 |
| 7,976,372 | B2 * | 7/2011 | Baerlocher et al. | 463/12 |
| 8,002,619 | B2 * | 8/2011 | Gagner et al. | 463/12 |
| 8,152,638 | B2 * | 4/2012 | Fujimoto | 463/34 |
| 8,167,700 | B2 * | 5/2012 | Fujimoto | 463/16 |
| 8,231,458 | B2 * | 7/2012 | Baerlocher et al. | 463/25 |
| 8,235,812 | B2 * | 8/2012 | Baerlocher et al. | 463/30 |
| 8,241,124 | B2 * | 8/2012 | Kelly et al. | 463/34 |
| 8,267,764 | B1 * | 9/2012 | Aoki et al. | 463/16 |
| 2005/0020358 | A1 * | 1/2005 | Cram | 463/31 |
| 2005/0282623 | A1 * | 12/2005 | Matsuno et al. | 463/25 |
| 2009/0117994 | A1 * | 5/2009 | Kelly et al. | 463/25 |

* cited by examiner

*Primary Examiner* — William Pierce
(74) *Attorney, Agent, or Firm* — DeLizio Gilliam, PLLC

(57) ABSTRACT

Electronic wagering game tables (a.k.a. e-tables) are described herein. Some embodiments include a wagering game table for presenting a wagering game. The wagering game table can include a projection surface, and a first projector configured to present, at a first resolution, a first background image on the projection surface, wherein the first background image is associated with the wagering game and includes elements of the wagering game that are shared by the plurality of players, and wherein the first background image includes blank areas that are not substantially illuminated with content from the first projector. The wagering game table can also include a plurality other projectors configured to present, at a second resolution, wagering game content in the plurality of blank areas, wherein the wagering game content indicates results of the wagering game.

25 Claims, 13 Drawing Sheets

MULTI-PROJECTOR GAMING TABLE

RELATED APPLICATIONS

This application claims the priority benefit of U.S. Provisional Application Ser. No. 61/261,316 filed Nov. 14, 2009.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2010, WMS Gaming, Inc.

FIELD

Embodiments of the inventive subject matter relate generally to wagering game systems, and more particularly to wagering game systems including multi-projector gaming tables.

BACKGROUND

Wagering game machines, such as slot machines, video poker machines and the like, have been a cornerstone of the gaming industry for many years. Electronic wagering game tables (a.k.a. e-tables) can combine the best of traditional table games (e.g., black jack, roulette, baccarat, etc.) and wagering game machines because a live dealers can facilitate play while wagers are placed electronically through electronic wagering interfaces. An e-table provides an electronic wagering interface for players participating in a game. The electronic wagering interfaces present wagering options to the players and allow the players to place wagers. For example, an e-table configured for roulette comprises a roulette wheel and an array of electronic wagering interfaces that present the numbers to each player. A player places bets by selecting numbers using an input area (e.g., a group of buttons, a touch screen, etc.) on the electronic wagering interface, rather than placing chips on numbers on the table.

BRIEF DESCRIPTION OF THE FIGURES

Embodiments of the invention are illustrated in the Figures of the accompanying drawings in which.

DESCRIPTION OF THE EMBODIMENTS

This description of the embodiments is divided into four sections. The first section provides an introduction to embodiments of the invention, while the second section describes example wagering game machine architectures. The third section describes example configurations and operations. The fourth section describes how embodiments may be used in wagering game networks, and the fifth section presents some general comments.

Introduction

This section provides an introduction to some embodiments of the invention.

Electronic wagering game tables ("e-tables") can enhance traditional table games by including electronic wagering interfaces and electronic output devices. However, an e-table configured for one game may not be configurable other games. In some embodiments of the inventive subject matter, an e-table includes projectors that enable easy reconfiguration for different games. A digital video projector ("projector") can present, on the e-table, a background image that represents wagering game content common to several players participating in a wagering game. For example, the projector can present an image representing a felt surface of a black jack table. Other projectors can present content in different player areas, where the player areas correspond to areas at which players sit at the e-table. The background image (e.g., the image representing a felt surface) and the content in the player areas can be presented at different resolutions. For example, the resolution for content in the player area may be higher than the resolution of the background image. If casino managers want to reconfigure the e-table to play a different game (e.g., No Limit Texas Hold 'Em), they can program the e-table to present different content in the background and in the player areas. These concepts are described with more detail in the discussion of FIG. 1.

Figure 1:
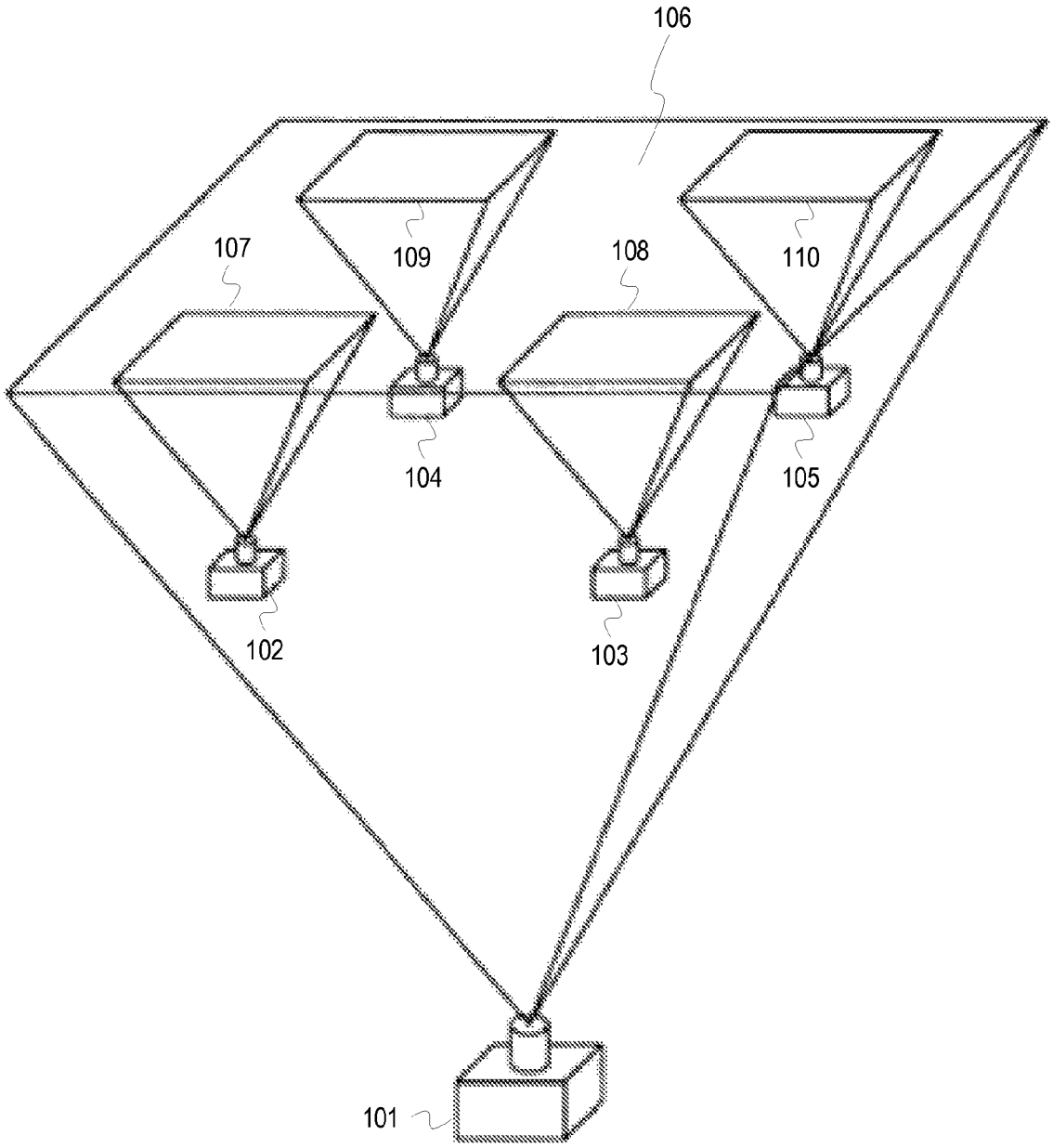
FIG. 1 is a conceptual diagram illustrating how an e-table can use multiple projectors to present wagering games.

FIG. 1 is a conceptual diagram illustrating how an e-table can use multiple projectors to present wagering games. An e-table can include a projection surface 106 on which wagering games are presented. The projection surface 106 can be constructed from any material suitable for rear projection, front projection, or both. The e-table can present individual and community wagering games on the projection surface 106. In some community wagering games, players can compete against each other or against a dealer. For example, in some community games, players may compete against each other to win a progressive jackpot for a spinning reel type wagering game, such as slots. In other community games, such as blackjack, players may compete against a dealer. In yet another community games, players may bet on one of two card hands (e.g., like in baccarat). Multiple players may also place wagers on other aspects of the wagering game.

As shown in FIG. 1, a projector 101 projects a background image over the entire projection surface 106. In some embodiments, the background image represents content of the wagering games that is common to all players participating in wagering games at the e-table. For example, the background image can include graphics associated with a theme (e.g., Star Trek™, Viva Monopoly™, The Wizard of Oz™, etc.) of a wagering game. As another example, the background image can display a jackpot amount. As another example, the background image can represent a felt surface of a blackjack table, and it may also include graphics representing a dealer's blackjack hand and/or shared game elements.

The projector 101 may be configured to show blank areas in a background image. That is, the projector may not substantially illuminate certain areas of a background image to accommodate other images shown by other projectors. In FIG. 1, the projector 101 projects a background image with four blank areas that correspond to player areas 107.

In some embodiments, the player areas 107 are flush with the projection surface 106. The projection surface 106 can be a single medium that accommodates the background image and foreground images in the player areas 107. In other instances, the projection surface 106 includes a plurality of components assembled to form the projection surface 106 and the player areas 107. The components may be made of the same or different materials (e.g., the materials comprising the player areas 107 may be of different material than the rest of the display surface 106).

In some instances, the projectors 102, 103, 104, & 105 project wagering game content into the player areas 107. In some embodiments, each player area 107 corresponds to a single player sitting/standing at the e-table. For example, each of the player areas 107 can display a corresponding player's spinning reels, credit meter, win meter, wager amount, etc. As another example, each of the player areas 107 can display a corresponding player's blackjack hand, wager, win meter, etc. In some embodiments, the wagering game content in the player areas 107 can include player avatars, financial account information, information from a gaming-related website, trophies, achievements, etc.

The wagering games can utilize live dealers and tangible game pieces (e.g., physical cards). For example, a background image can represent a blackjack table, baccarat table, Texas Hold 'Em table, etc. A dealer can deal cards on to the projection surface 106. In some instances, the projector's background image includes boundaries and/or markings that indicate where certain tangible cards are to be dealt and played on the projection surface 106. The player areas 107 can show information about wagers, odds, credits, etc. In some embodiments, the projectors 102-105 deliver content onto the display surface 106 via rear projection, so players can interact with tangible game pieces (e.g., playing cards) on the projection surface 106 without casting shadows or otherwise obscuring content shown on the projection surface 106.

The projector 101 can present the background image on the projection surface 106 at one resolution, whereas the other projectors 102-105 can present other images at a higher resolution. In some instances, the projectors have different native resolutions. For example, the projectors 101 & 102-105 may have native resolutions of 800×600, 1280×800, 1920×1080 etc. Sometimes, the image resolution of each projector may differ based on the size of its display area (i.e., its image size). If the projector 101 has native resolution of 1920×1080 and its display area is 56 inches diagonal, the projector's image resolution may be about 39 pixels per inch. If the projectors 102-105 have native resolution 800×600 and their display areas are 12 inches diagonal, the projectors' image resolutions may be about 83 pixels per inch. Therefore, projectors with lower native resolution can render higher resolution images than other projectors having higher native resolutions. Furthermore, in some instances, materials comprising the projection surfaces may affect image resolution. That is, when both display area sizes and native resolutions are the same, different projection media may affect a projector's image resolution.

In some instances, foreground images (i.e., images in the player areas) are more detailed than background images, so some foreground images require higher resolution to avoid appearing "grainy." For example, player-specific game elements, such as images of playing cards, slots reels, chips, etc. may be best shown at high resolution to convey detailed information to players. Background images that do not require high resolution can include lines and boundaries, block text, logos, etc.

In some embodiments, the projection surface 106 includes a liquid crystal display (LCD) with cut-outs located at the player areas 107. In such embodiments, the LCD can present background images, while the projectors 102-105 present content in the player areas 107. In some instances, the projector 101 could provide back lighting for the LCD.

Although not shown in FIG. 1, the e-table can also comprise a player input interface that allows the player to interact with the e-table. The player input interface can comprise a series of buttons, a touch screen, a keyboard and mouse, etc. In some instances, the player areas 107 can be configured as a touch screen. Additionally, the e-table can include a camera and/or other components for monitoring tangible game pieces.

Figure 2:
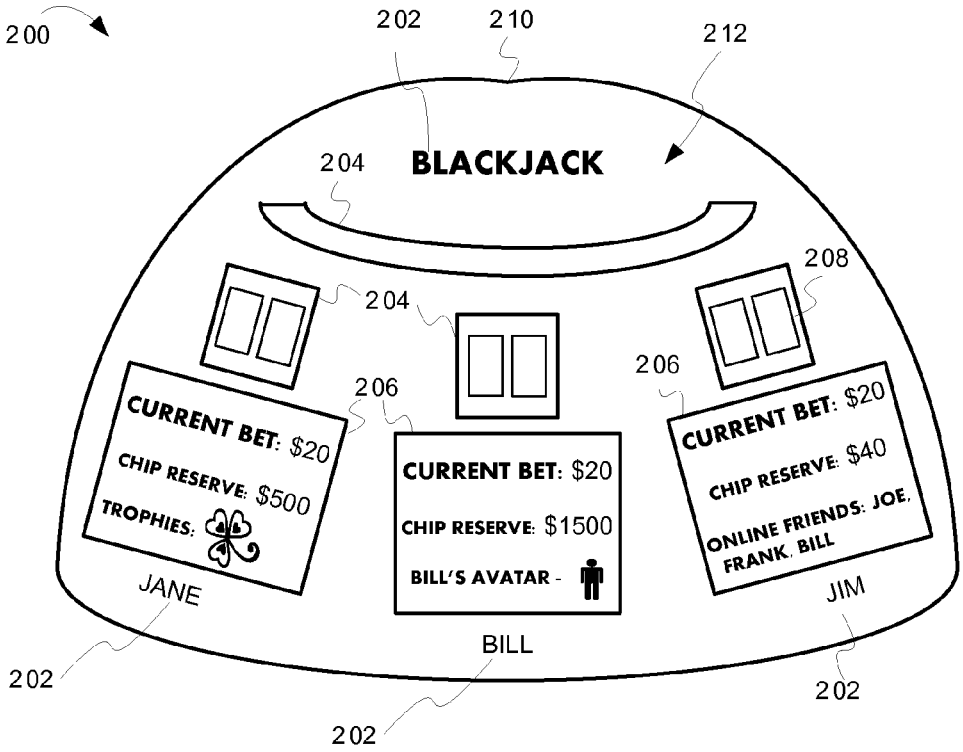
FIG. 2 illustrates an overhead view of an e-table arranged for playing blackjack with playing cards, according to some embodiments of the invention.

FIG. 2 illustrates an overhead view of an e-table arranged for playing blackjack with tangible playing cards, according to some embodiments of the invention. In FIG. 2, the e-table 200 includes a projection surface 210 divided into player areas 206 and a common area 212. In some instances, the common area 212 includes the entire projection surface 210 except for the player areas 206. As shown, the common area 212 includes boundaries 204 defining a blackjack table, and text 202 identifying players and the game. As shown, the e-table 200 is configured for playing blackjack with tangible playing cards 208. The e-table augments the traditional blackjack experience by presenting additional player-specific information in the player areas 206. In FIG. 2, the player-specific information includes current bet amounts, chip reserves, trophies, avatars, and online friends. The player-specific information can include any suitable information.

Casino managers can reconfigure the e-table 200 to present a different game that uses tangible playing cards (e.g., Texas Hold 'Em), or they can reconfigure the e-table 200 for a fully electronic game such as slots. Reconfiguring the e-table 200 for another card game may entail projecting different boundaries onto the common area 212. Reconfiguring the e-table 200 for a fully electronic game, such as slots, may entail projecting graphical spinning reels onto the projection surface 210. In some instances, multiple players can bet on a single set of graphical spinning reels. In other instances, each player may bet on a different set of spinning reels. For example, the e-table may project a different set of spinning reels in each player's player area 206.

As similarly described above, one projector underneath the projection surface 210 can project content (e.g., images including the text 202 and boundaries 204) onto the common area 212, while other projectors can present content in the player areas 206. Content in the common area 212 can appear at one resolution, whereas content in the player areas can appear at a different resolution. As shown, embodiments of the projection surface can be any suitable shape. Likewise, the common area and player areas can be any suitable shape. Furthermore, in some instances, the projection surface can be contoured or otherwise non-planar. That is, the projection surface can by molded or otherwise formed to any suitable shape (e.g., to simulate a roulette wheel).

Although FIGS. 1 and 2 describe some embodiments, the following sections describe many other features and embodiments.

Operating Environment

This section describes an example operating environment and presents structural aspects of some embodiments. More specifically, this section describes architectures and networks for use with some embodiments of the inventive subject matter.

Wagering Game Machine Architectures

Figure 3:
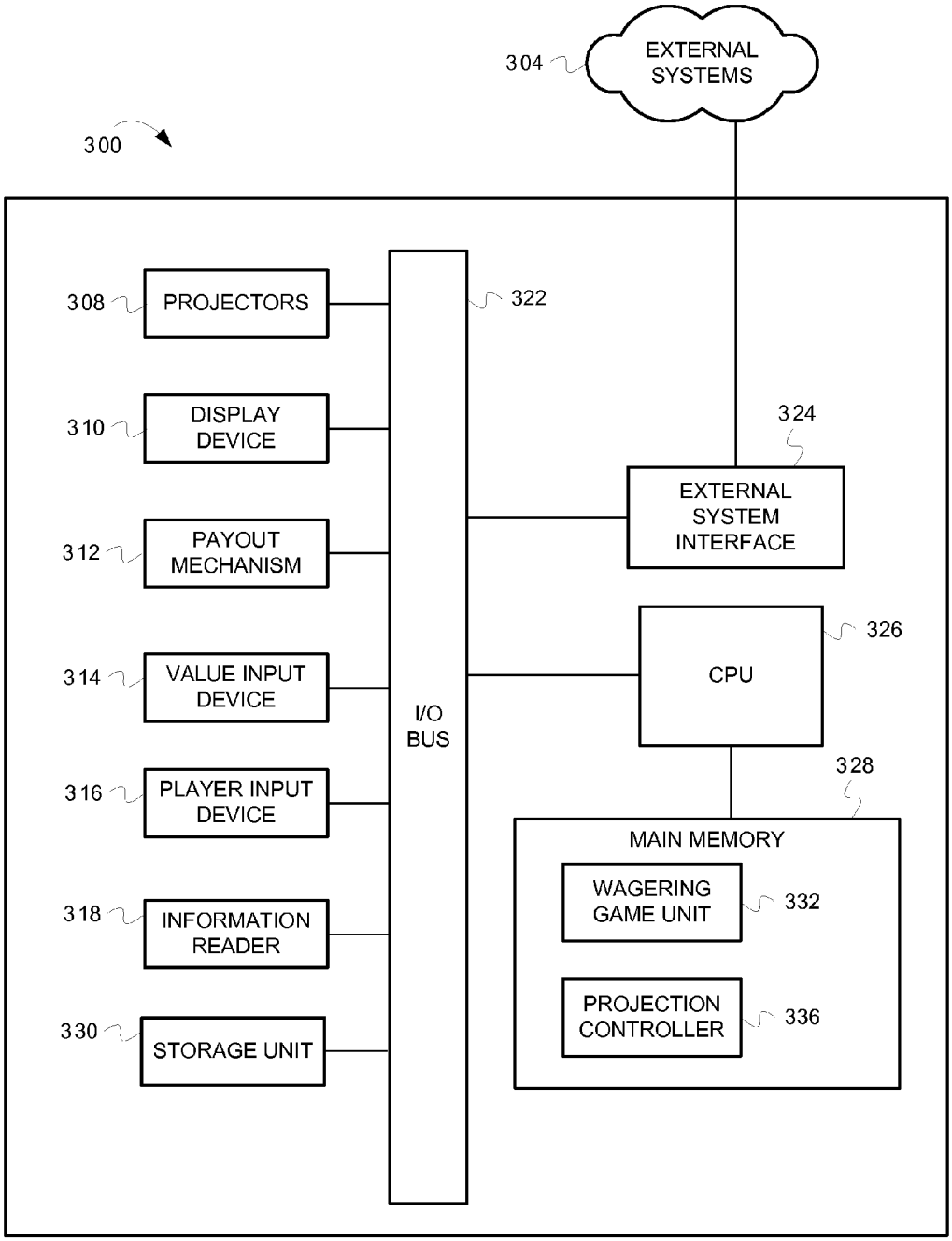
FIG. 3 is a block diagram illustrating a wagering game machine architecture, according to some embodiments of the invention.

FIG. 3 is a block diagram illustrating an electronic wagering game architecture, according to some embodiments of the invention. The architecture shown in FIG. 3 can be implemented in the form of an e-table or other wagering game devices, such as cabinet-style wagering game machines. As shown in FIG. 3, the wagering game machine architecture 300 includes a central processing unit (CPU) 326 connected to main memory 328. The CPU 326 can include any suitable processor, such as an Intel® Pentium processor, Intel® Core 2 Duo processor, AMD Opteron™ processor, or UltraSPARC processor. The main memory 328 includes a wagering game unit 332. In one embodiment, the wagering game unit 332 can present individual and community wagering games, such as video poker, video black jack, video slots, video lottery, etc.

The main memory 328 also includes a projection controller 336 that controls one or more projectors 308, which can present background content on a projection surface (not shown in FIG. 3) and other content in specific areas of the projection surface. In some instances, the projection controller 336 can configure each of the projectors 308 to present content at different resolutions. In some embodiments, the projection controller 336 includes hardware components, such as an add-in card connected to the input/output (I/O) bus 322.

The CPU 326 is connected to the I/O bus 322, which can include any suitable bus technologies, such as an AGTL+ frontside bus and a PCI backside bus. The I/O bus 322 is connected to a payout mechanism 308, display device 310, value input device 314, player input device 316, information reader 318, and storage unit 330. The player input device 316 can include the value input device 314 to the extent the player input device 316 is used to place wagers. The I/O bus 322 is also connected to an external system interface 324, which is connected to external systems 304 (e.g., wagering game networks). In some embodiments, the external systems 304 can also include projectors for displaying wagering game content on projection surfaces outside the e-table (or other device embodying the architecture 300).

The projectors 308 can include any suitable projection technology. Thus, the projectors 308 can be Liquid Crystal Display (LCD) projectors, Digital Light Processor (DLP) projectors, Liquid Crystal on Silicon (LCOS) projectors, Liquid Crystal Laser (LCL) projectors, etc.

In one embodiment, the architecture 300 can include additional peripheral devices and/or more than one of each component shown in FIG. 3. For example, in one embodiment, the architecture 300 can include multiple external system interfaces 324 and/or multiple CPUs 326. In one embodiment, any of the components can be integrated or subdivided.

Any component of the architecture 300 can include hardware, firmware, and/or tangible machine-readable media including instructions for performing the operations described herein. Tangible machine-readable media includes any tangible mechanism that provides (i.e., stores and/or transmits) information in a form readable by a machine (e.g., a wagering game machine, computer, etc.). For example, tangible machine-readable media includes read only memory (ROM), random access memory (RAM), magnetic disk storage media, optical storage media, flash memory machines, etc.

Configurations and Operations

This section describes example configurations and operations of some embodiments of the inventive subject matter. This section will discuss FIGS. 4-13.

Figure 4:
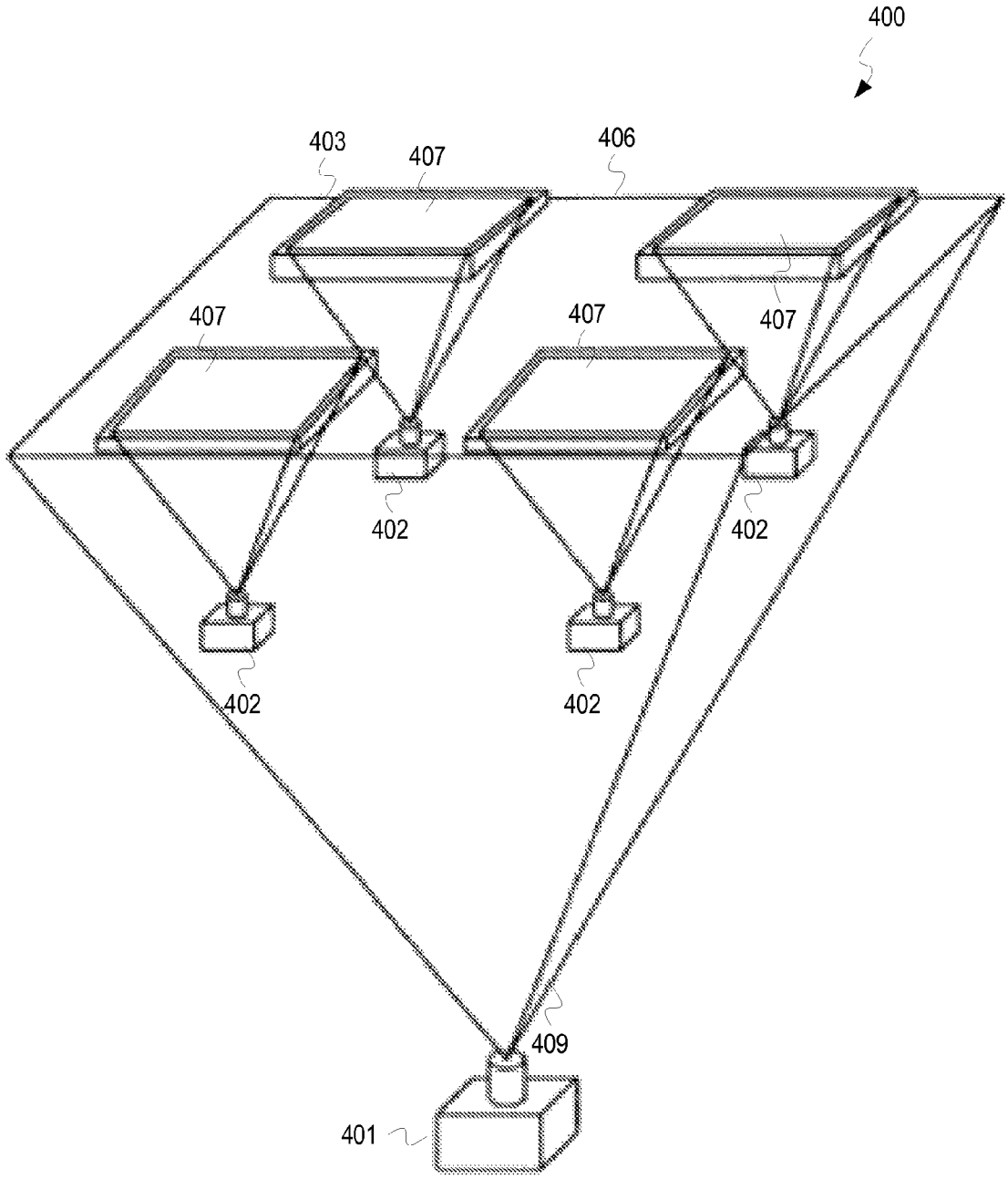
FIG. 4 shows an e-table including multiple projection surfaces on which multiple projectors present content.

FIG. 4 shows an e-table including multiple projection surfaces on which multiple projectors present content. In FIG. 4, an e-table 400 comprises a plurality of projection surfaces including a common surface 406 and player surfaces 407. The e-table 400 also includes a projector 401 that can project a background image onto the common surface 406 (e.g., see projected images 409). In some instances, the background image is relevant to all players at the e-table. For example, the background image can portray a theme of a wagering game, a progressive jackpot amount, shared game elements (e.g., shared playing cards), etc. The e-table 400 also includes projectors 402 that present content on the player surfaces 407. Although not shown in FIG. 4, the e-table 400 can also include additional input/output devices such as trackballs, buttons, touch screens, speakers, etc.

In FIG. 4, the player surfaces 407 are raised above the common surface 406. Additionally, the player surfaces 407 can be tilted or oriented to enhance viewing. In some embodiments, the player surfaces 407 are held in-place with bezels 403. Alternatively, the surfaces 407 can be supported with adjustable mounting brackets (not shown) or other suitable support hardware.

In some embodiments, each player surface 407 corresponds to a player sitting or standing at the e-table 400. Thus, each player area 407 can show wagering game content specific to a particular player. For example, the e-table 400 may be configured to present a video Texas Hold 'Em card game in which shared cards appear on the common surface 407, and individual players' cards appear on the player surfaces 407.

The projectors 402 and the projector 401 can present content at different resolutions. For example, if a projector 402 is presenting relatively detailed content on a player surface 407, the projector 402 can present the content at a high resolution. While the projectors 402 are presenting content at high resolution, the projector 401 can present content of lesser detail at a lower resolution. Continuing with the Texas Hold 'Em example from above, the projectors 402 may present, to each player, various information such as individual cards, financial account information, current bet amount, sports scores, drink order status, etc. The projectors 402 may present such information in high resolution on the player surfaces 407. The projector 401 may present, on the common surface 406, shared cards and a game logo as very large, lower-resolution graphics.

Because the player surfaces 407 are raised above the common surface 406, the projectors 402 have different focal lengths than the projector 401. As shown, the projector 401 and projectors 402 can be configured for rear projection onto the projection surfaces 406 and 407.

Figure 5:
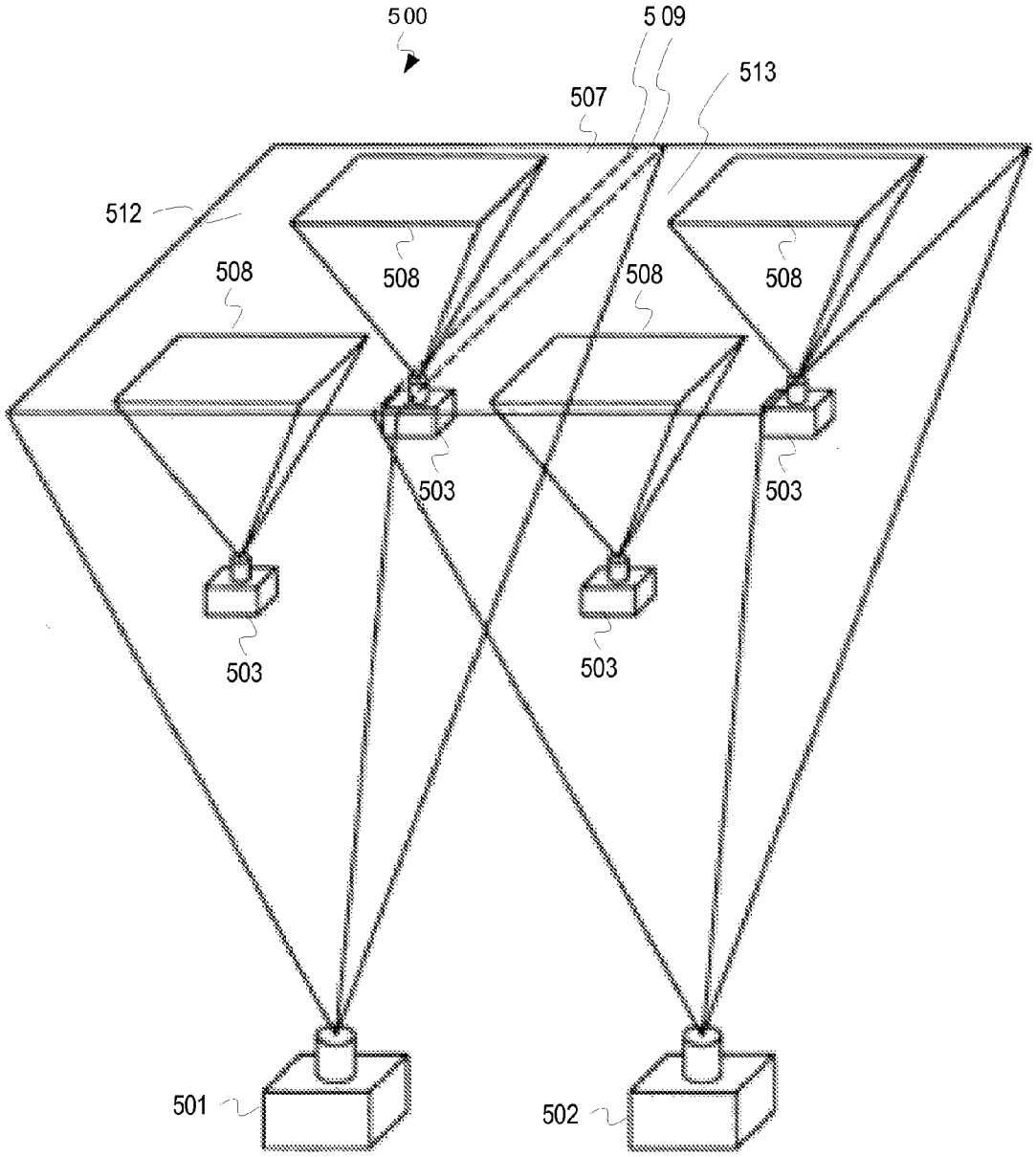
FIG. 5 shows an e-table configuration in which multiple projectors project a single background image.
Figure 6A:
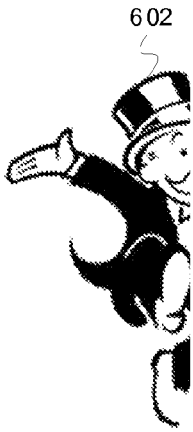
FIGS. 6A and 6B show sub-images that can be combined to form a single image.
Figure 6B:
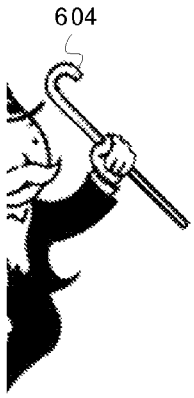
Figure 6C:
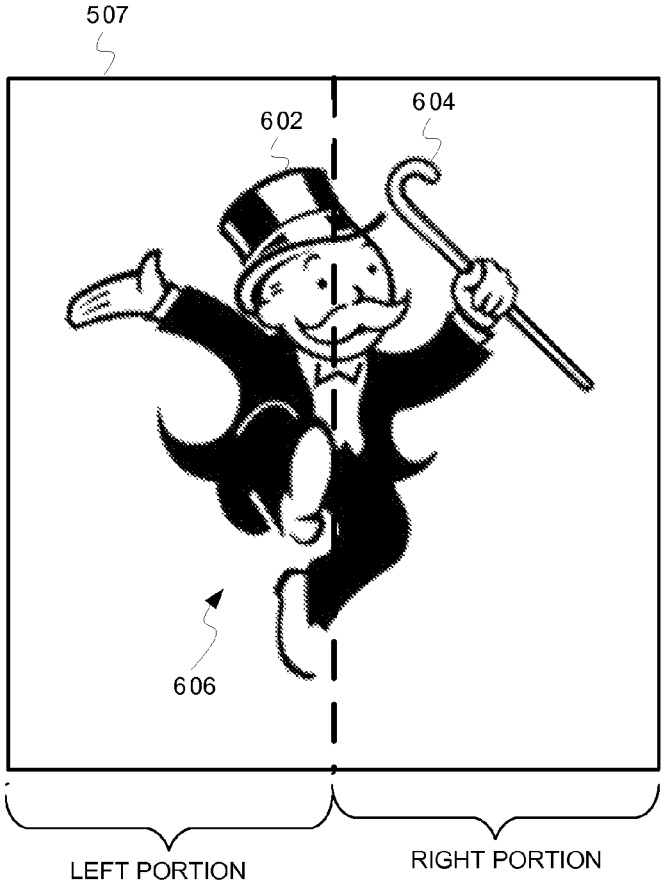
FIG. 6C shows the single image formed from the sub-images.

Sometimes an e-table's projection surface may be too large for a single projector to display a background image over the entire projection surface. Therefore, in some embodiments, multiple projectors can project images that are combined to form the background image. FIG. 5 shows an e-table configuration in which multiple projectors project a single background image. In FIG. 5, an e-table 500 includes a projection surface 507 and projectors 501 and 502. The projector 501 can project a first image on a left portion 512 of the projection surface 507. The projector 502 can project a second image on a right portion 513 of the projection surface 507. Because the images are juxtaposed on the projection surface 507, the images combine to form a single background image across the entire projection surface 507. FIGS. 6A-6C illustrate this concept in more detail.

FIGS. 6A and 6B show sub-images 602 and 604 that can be combined to form a single image. FIG. 6C shows the single image 606 formed from the sub-images 602 and 604. Referring back to FIG. 5, the projector 501 can project the sub-image 602 onto the left portion 512 of the projection surface 507. Contemporaneously, the projector 502 can project the sub-image 604 onto the right portion 513 of the projection surface 507. When the projectors 501 and 502 show the sub-images 602 and 604 in juxtaposition on the projection surface 507, the sub-images 602 and 604 combine to form the single image 606 on the projection surface 507.

In some embodiments, the projectors or other components (e.g., a projection controller) can use stitching or other techniques for merging images. In some embodiments the projectors 501 and 502 may slightly overlap on the sub-images, to allow stitching or other blending techniques to create a smooth transition between the sub-images (dotted lines 509 indicate overlapping). In some embodiments, the images combine to form a single background image across the entire projection surface 507.

In FIG. 5, the projection surface 507 includes player areas 508 in which the projectors 503 present content to particular players. Each player area 508 can correspond to a different player sitting/standing at the e-table 500. The player areas 508 can appear on the projection surface 507 or on other projection surfaces (e.g., projection surfaces pressed-into cutouts in the surface 507). To prevent interference, the projectors 501 and 502 can "black-out" or "mask-off" portions of the background image that correspond to the player areas 508. As a result, in some instances, only the projectors 503 will be presenting content in the player areas 503.

Figure 7:
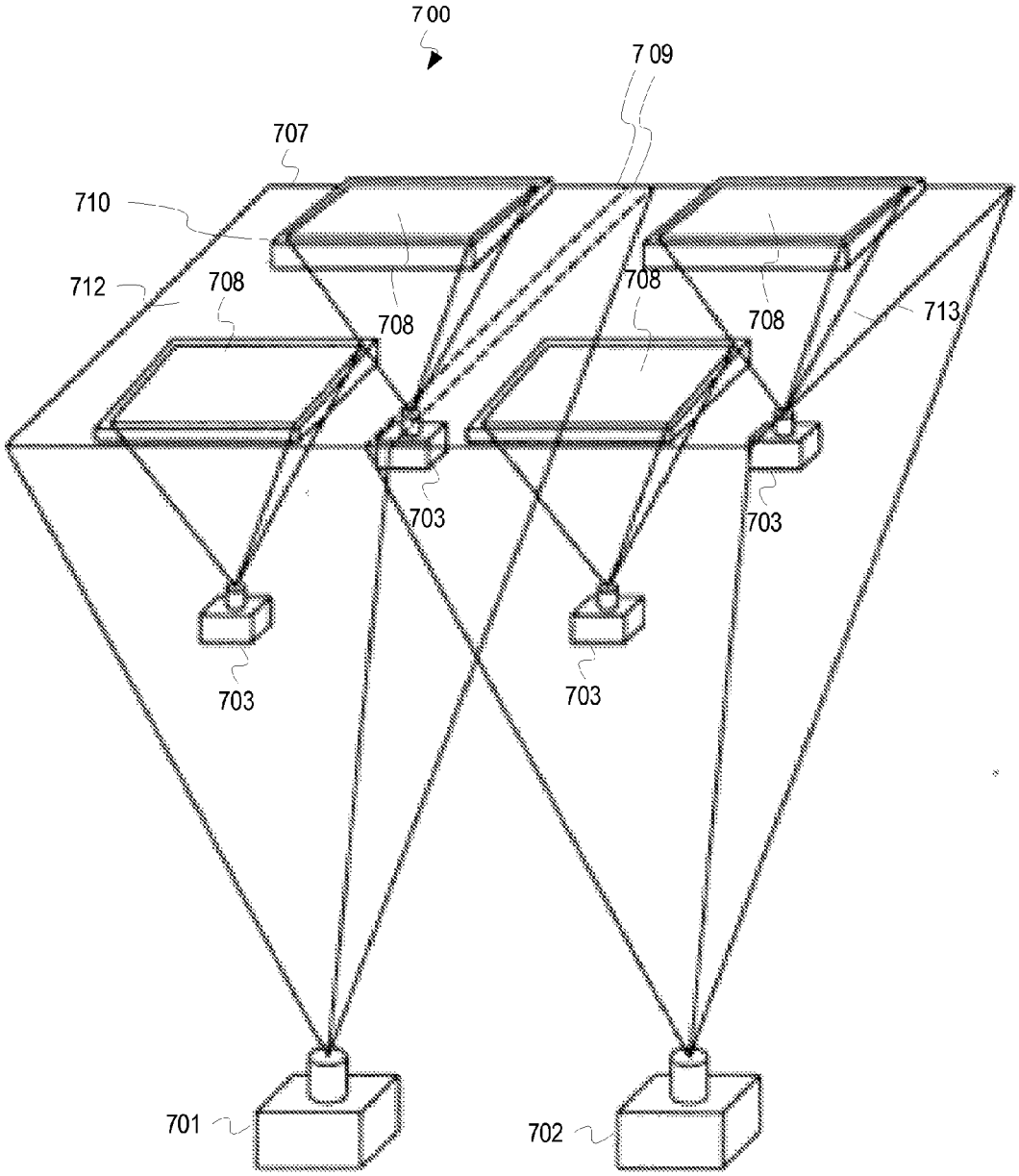
FIG. 7 shows another e-table configuration in which multiple projectors project a single background image.

FIG. 7 shows another e-table configuration in which multiple projectors project a single background image. In FIG. 7, an e-table 700 includes projectors 701 and 702, projectors 703, and projection surfaces 707 and 708. The e-table 700 is similar to FIG. 6's e-table 600, as the projectors 701 and 702 can present images that combine to form a single background image on the projection surface 707. To form a single background image, the projector 701 can present a first image in a left portion 712 of the projection surface 707, while the projector 702 can present a second image in a right portion 713 of the projection surface 702. In some instances, the images overlap (overlapping indicated by dotted lines 709).

The projection surfaces 708 can correspond with player areas in which the projectors 703 can present player-specific data to players seated/standing at the e-table 700. In FIG. 7, the projection surfaces 708 are tilted to improve viewing by players at the e-table 700. The projection surfaces 708 can be retained by bezels 710, held by adjustable mounts, or held with other suitable hardware. The projectors 701 and 702 may mask-off (i.e., not substantially illuminate) certain portions of their images, as discussed above.

Figure 8:
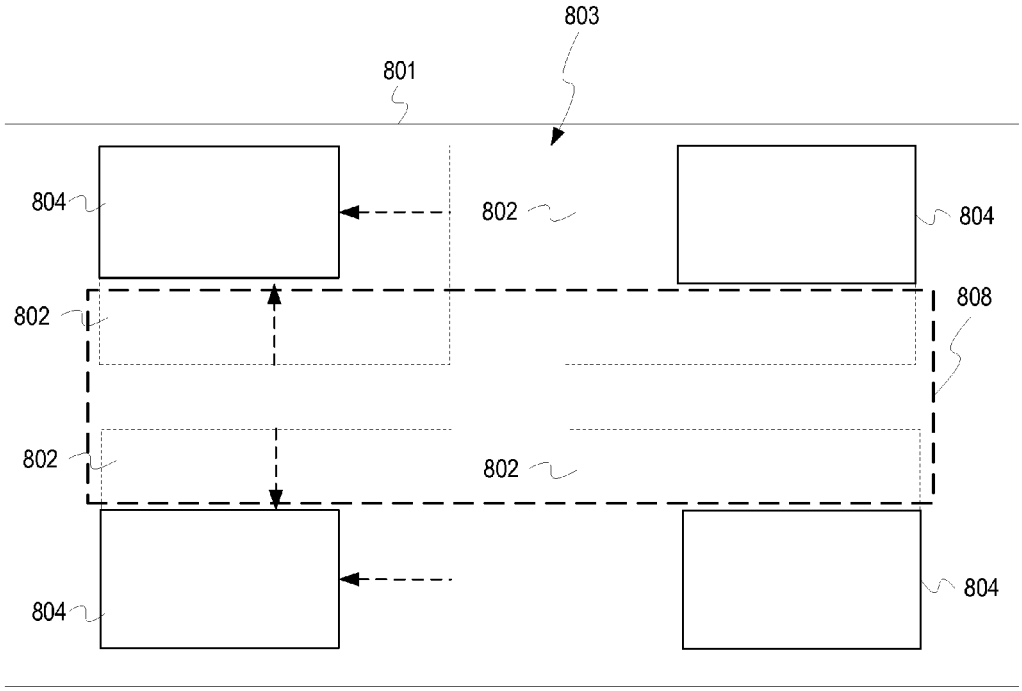
FIG. 8 shows how an e-table projection surface can be dynamically rearranged, according to some embodiments of the invention.

FIG. 8 shows how an e-table projection surface can be dynamically rearranged, according to some embodiments of the invention. In FIG. 8, a projection surface 801 includes initial player areas 802 and an initial common area 803. The initial common area 803 includes all area on the projection surface 801 that is not occupied by the initial player areas 802. In this example, the initial player areas 802 are arranged symmetrically near the projection surface's corners. However, the initial player areas can reside anywhere on the projection surface 801. For example, if the projection surface were a bar top, the initial player areas may reside in a row along the bottom edge of the projection surface 801. Furthermore, the projection surface 801 can be any suitable shape (circle, semi-circle, etc.).

In some embodiments, some projectors present community content in the initial common area 803, while other projectors present player-specific content in the initial player areas 802. The projectors can present content at different resolutions (e.g., images in common areas are one resolution, and images in the player areas are another resolution). In some instances, the projector(s) presenting community content do not substantially shine light in the initial player areas 802.

According to some embodiments of the invention, the e-table can dynamically resize the initial player areas 802 and the initial common area 803. As shown in FIG. 8, the e-table can shrink and relocate the initial player areas 802, forming the modified player areas 804. After forming the modified player areas 804, the e-table can expand the common area 803 into areas formerly occupied by the initial player areas 802. Thus, after shrinking and moving the initial player areas, the e-table creates an expanded common area 808. In some embodiments, the e-table dynamically resizes player and common areas when presenting a community wagering games. For community wagering games, the e-table may present shared game elements (e.g., shared playing cards) in the expanded common area 808.

As part of a process for dynamically resizing the player and common areas, the e-table can shrink, crop, or otherwise resize content to fit in the modified player areas 804. Conversely, the e-table can enlarge and otherwise augment common content. Operations for resizing content are discussed in more detail below, in the discussion of FIG. 10.

This discussion continues by providing additional techniques for dynamically resizing player and common areas on a projection surface. When players sit at a traditional wagering table, the players do not typically sit in an evenly spaced pattern. For example, two friends may sit close together, whereas strangers may sit further apart. An e-table may be able to determine where players are sitting and adjust the player areas accordingly.

Figure 9:
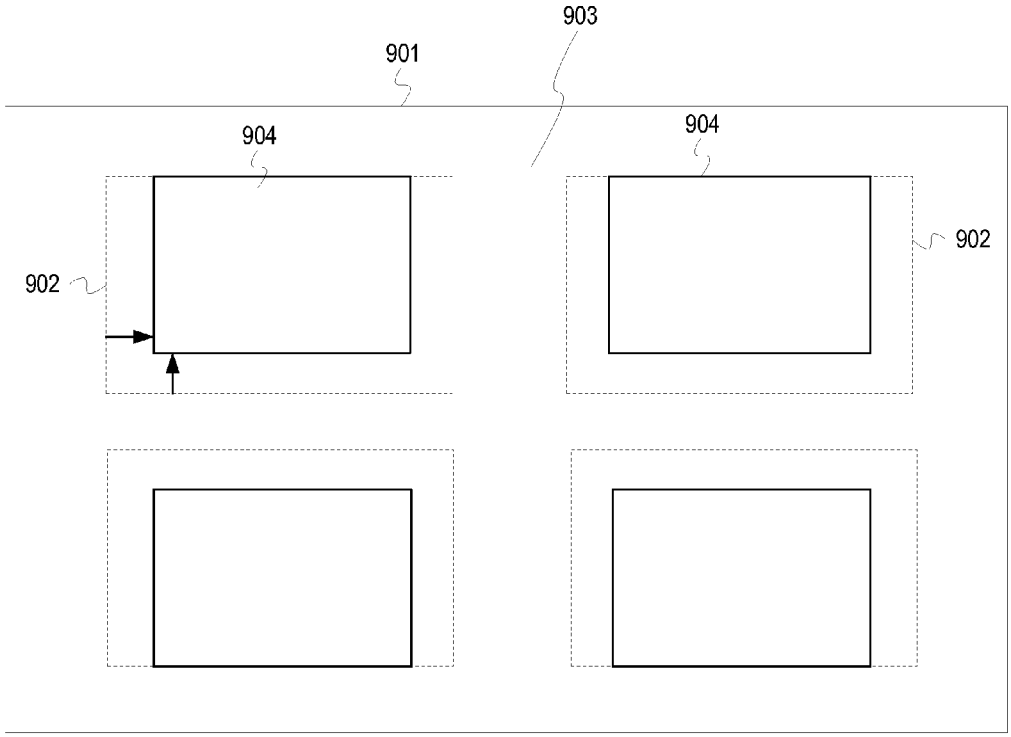
FIG. 9 shows yet another technique for dynamically rearranging an e-table projection surface, according to some embodiments of the invention.

FIG. 9 shows yet another technique for dynamically rearranging an e-table projection surface, according to some embodiments of the invention. The e-table projection surface 901 includes initial player areas 902 and an initial common area 903. In some embodiments, the e-table can dynamically resize the initial player areas, forming the modified player areas 904. The common area changes as a result of resizing the player areas. The e-table can dynamically reconfigure the projection surface layout based on where players sit at the e-table. In some embodiments, players can provide input that adjusts player areas. In yet other embodiments, the e-table may determine a location of a player's chair (e.g., based on sensors in the chairs and/or table, based on radio frequency identification (RFID) tags, etc.) and adjust a player area accordingly.

This discussion continues with a method for dynamically reconfiguring an e-table to present community wagering games and events.

Figure 10:
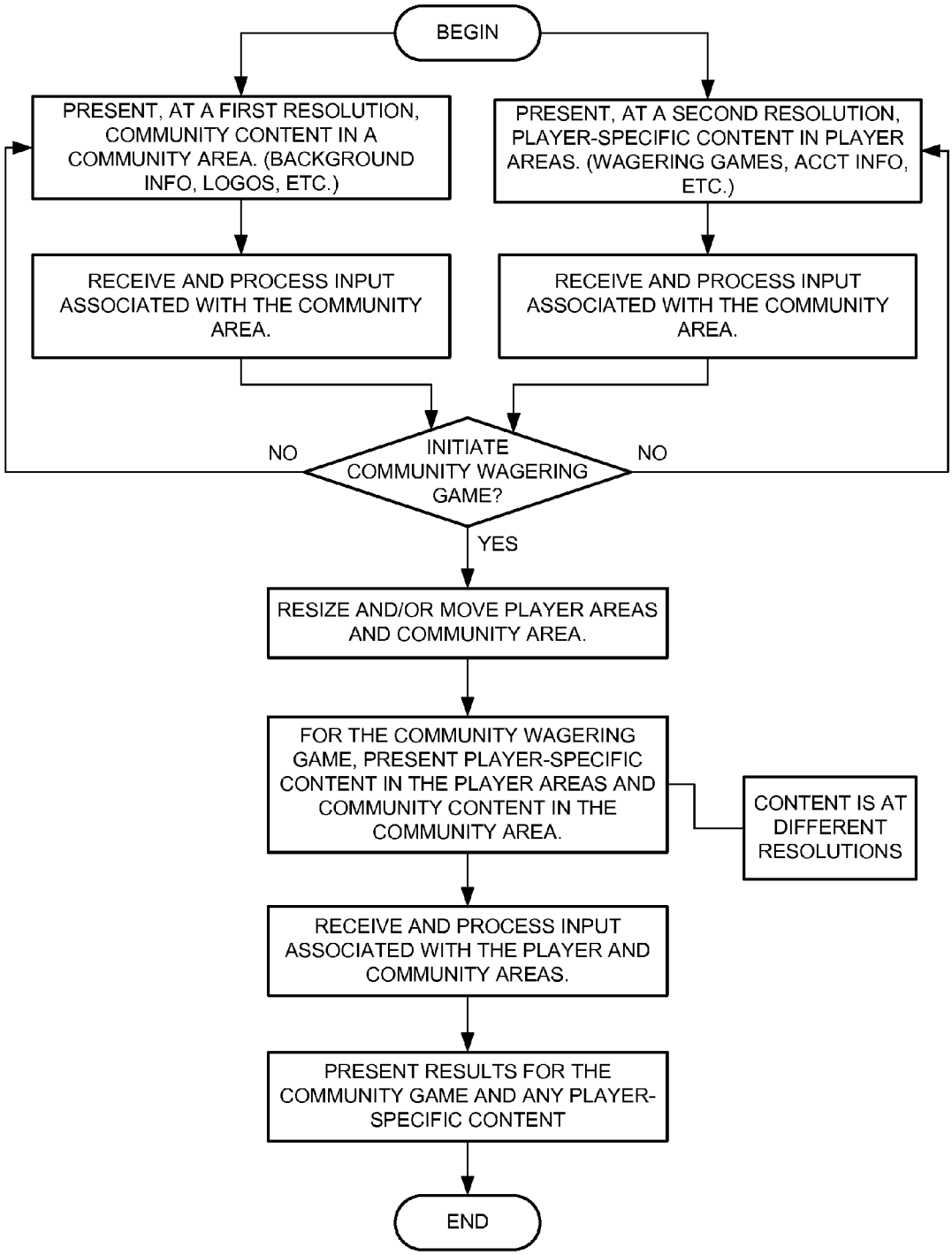
FIG. 10 is a flow diagram illustrating operations for dynamically reconfiguring an e-table's projection surface, according to some embodiments of the invention.

FIG. 10 is a flow diagram illustrating operations for dynamically reconfiguring an e-table's projection surface, according to some embodiments of the invention. The operations in the flow 1000 will be described with reference to the different e-tables and projection surface layouts discussed above. In FIG. 10, the flow 1000 begins in parallel at blocks 1002 and 1006.

At block 1002, an e-table's projector presents community content in a community area of a projection surface. For example, the projector may present community content in an initial common area (see the initial community area 803 of FIG. 8). Because the common area may be relatively large, the projector can present community content in high-definition, but at a lower resolution than other content displayed on the projection surface. The community content can include general information, logos, shared game elements, etc. The flow continues at block 1004.

At block 1004, the e-table receives and processes input associated with the common area. The community content in the common area may prompt player input. In turn, the e-table (e.g., the e-table's wagering game unit 332) processes the input and responds accordingly.

At block 1006, the e-table presents player-specific content in player areas on the projection surface. For example, the e-table's display projectors can present different player-specific content in each of a plurality of initial player areas (e.g., see initial player areas 804 in FIG. 8). In some instances, the player-specific content appears in high-definition, and at a higher resolution than content in the common area. In some instances, content in the player areas appears in high resolution because player-specific content includes more information/details per square inch of projection surface. The player-specific content can include content for presenting wagering games (e.g., slots, video poker, video roulette, etc.) to individual players sitting/standing at the e-table. The flow continues at block 1008.

At block 1008, the e-table (e.g., the e-table's wagering game unit 332) receives and processes input associated with the player areas. The input can include player input associated with wagering games presented on the e-table (e.g., game elements selections, game initiation requests, etc.), and input received from events occurring away from the e-table (e.g., input from social contacts participating via a non-gambling website or other players associated with those playing at the e-table). The flow continues at block 1010.

At block 1010, the e-table initiates a community wagering game. The e-table can initiate the community wagering game based on player input, events and wagering games presented at the e-table, events and games away from the e-table, etc. If the e-table initiates a community wagering game, the flow continues at block 1012. Otherwise, the flow continues in parallel at blocks 1002 and 1006.

At block 1012, the e-table (e.g., the projection controller 336) resizes and moves the player areas and the common area. For example, as described in FIG. 8, the e-table can move and shrink player areas, and expand the common area into space previously occupied by the player areas. Shrinking player areas makes room for more content in the common area, increasing excitement and enhancing player experiences. The e-table is not limited to shrinking the player areas and expanding the common area, as the e-table can resize the player and common areas in any suitable fashion. The flow continues at block 1014.

At block 1014, the e-table presents content for the community wagering game. The e-table may present community wagering game content in the player areas and in the common area. For example, the community game may present each player with individual game elements, and the players may share community game elements. Individual game elements may appear in the player areas, whereas the community game elements may appear in the common area. The e-table may present content in the player areas at one resolution, while presenting content in the common area at a different resolution. In some instances, the player areas may not all show content at the same resolution.

In some instances, the e-table crops (i.e., truncates) content to fit in smaller player areas. Alternatively, the e-table may shrink the content and present it in a smaller space. To avoid losing detail, the e-table may present the shrunken content at a higher resolution. The flow continues at block 1016.

At block 1016, the e-table receives and processes input associated with the player and common areas. For example, the e-table receives player input associated with the community game. The player input can include game elements selections, wagers, etc. The flow continues at block 1018.

At block 1018, the e-table presents results for the community game and player-specific content associated with the community game. The community game results appear in the common area, whereas the player-specific content appears in the player areas. The player-specific content can include account updates (e.g., trophies, monetary balance, status, etc.) resulting from the community wagering game. From block 1018, the flow ends.

In addition to flat projection surfaces, projection surfaces can also be contoured to represent any three-dimensional shape. For example, e-tables can include contoured projection surfaces that simulate roulette wheels or other objects. A contoured projection surface simulates the roulette wheel's form factor, while projected graphics can simulate rotation of the wheel. The following discussion describes how some embodiments of the inventive subject matter use non-flat projection surfaces and multiple projectors.

Figure 11:
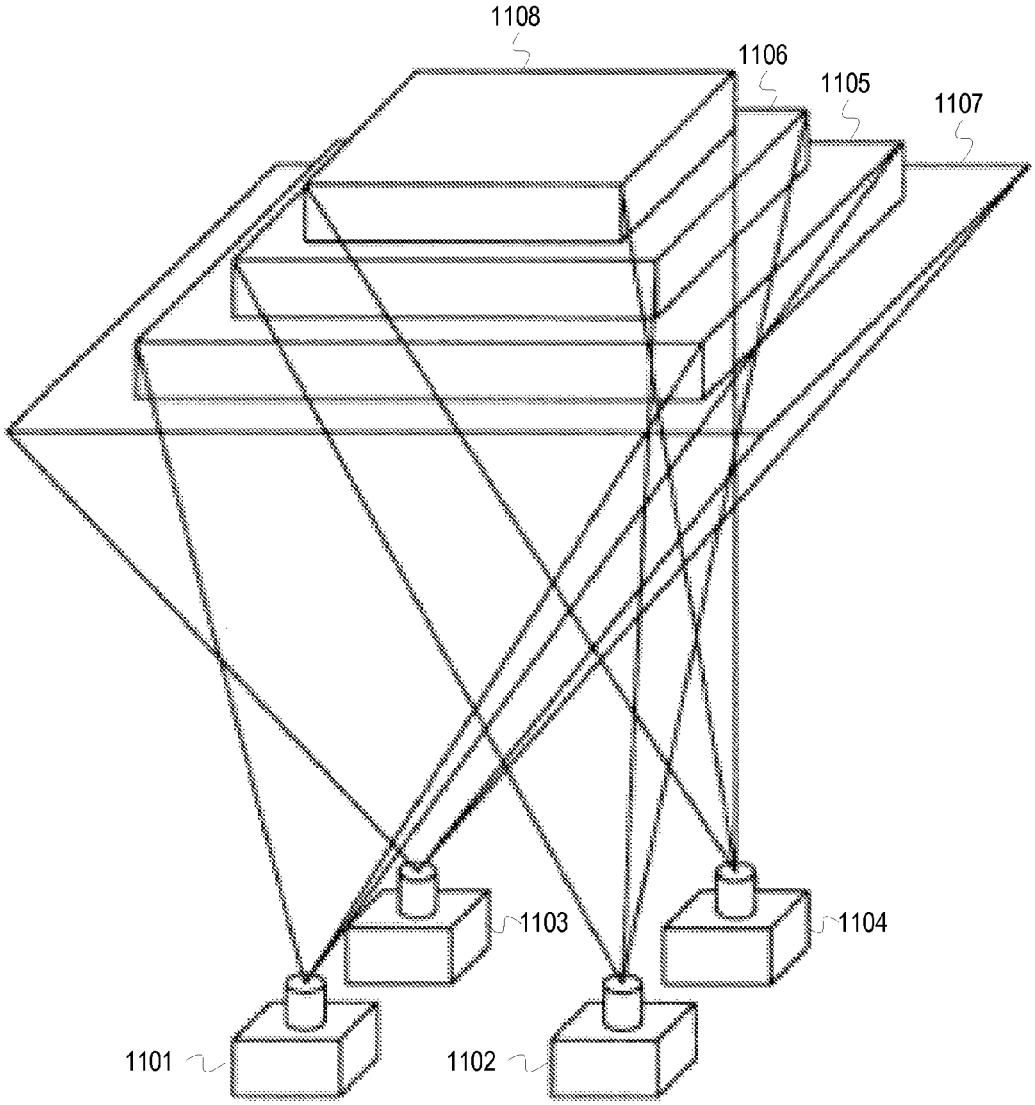
FIG. 11 shows an e-table with multiple projectors and a contoured projection surface.

FIG. 11 shows an e-table with multiple projectors and a contoured projection surface. As shown in FIG. 11, the projection surface is tiered, and includes sections 1105, 1106, 1107, and 1108. However, the projection surface can take any suitable three-dimensional shape. For example, the projection surface can be a shaped as a sphere, roulette wheel, etc. The projection surface 1102 may be made from one or more pieces of material.

A plurality of projectors may present material on the different sections of the projection surface 1102. In FIG. 11, a projector 1101 projects a first image on the section 1005, while another projector 1002 projects a second image on the section 1006. Additionally, projector 1003 projects a third image on the section 1007, and yet another projector 1004 projects a fourth image on the section 1008. In some embodiments, the e-table stitches together the first, second, third, and fourth images to form a composite image on the projection surface 1102. For example, the first, second, third, and fourth images form an image representing a roulette wheel. The projectors can be oriented at any angle to present content on the projection surface 1102.

Because the sections 1005-1008 are at different distances from the projectors 1001-1004, the projectors' focal lengths may be different. Alternatively, the projectors may be placed at different distances from the sections on which they project content. In some embodiments, the projectors can present content at different resolutions. For example, a projector may present a large background image in lower resolution than other smaller, more detailed images. Although not shown in FIG. 11, the projection surface 1102 can be organized to include a plurality of player areas and a common area, as similarly described above.

Figure 12:
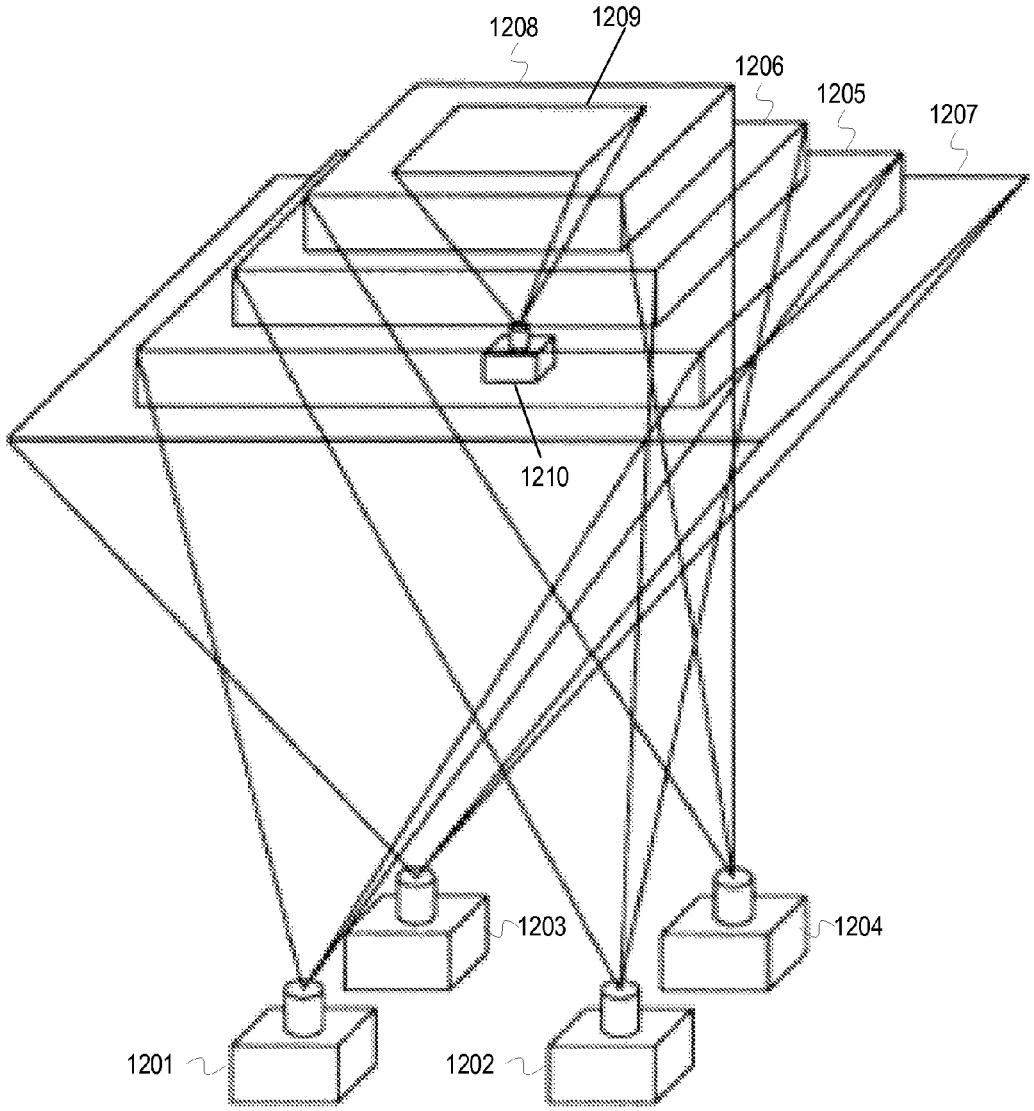
FIG. 12 shows another configuration for an e-table that includes non-planar projection surface, according to some embodiments of the invention.

FIG. 12 shows another configuration for an e-table that includes non-planar projection surface, according to some embodiments of the invention. The e-table configuration in FIG. 12 includes all the components shown in FIG. 11, with one additional projector. In FIG. 12, the projector 1210 can present content 1209 on the top section 1208 of the projection surface 1202. As noted above, each projector can be configured for a different focal length and different resolution, enabling clear content presentation on the different sections.

The configurations in FIGS. 11 and 12 can be modified for use with any non-planar projection surface. That is, the projectors' focal lengths and resolutions can be adjusted to present content on different sections of any non-planar projection surface.

Wagering Game Networks

Figure 13:
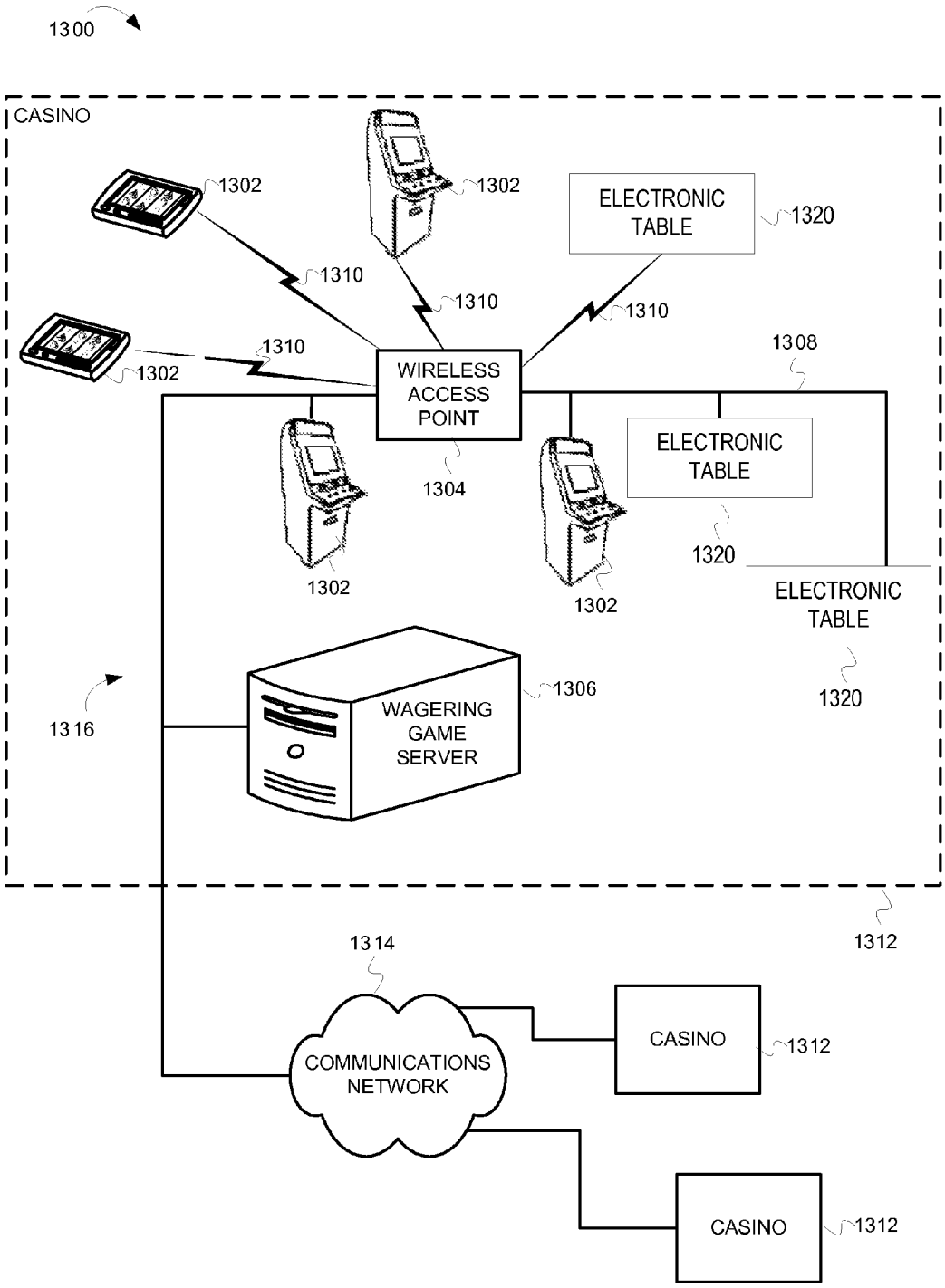
FIG. 13 is a block diagram illustrating a wagering game network 1300, according to example embodiments of the invention.

FIG. 13 is a block diagram illustrating a wagering game network 1300, according to example embodiments of the invention. As shown in FIG. 3, the wagering game network 1300 includes a plurality of casinos 1312 connected to a communications network 1314.

Each casino 1312 includes a local area network 316, which includes an access point 1304, a wagering game server 1306, wagering game machines 1302, and e-tables 1320. The access point 304 provides wireless communication links 1310 and wired communication links 1308. The wired and wireless communication links can employ any suitable connection technology, such as Bluetooth, 802.11, Ethernet, public switched telephone networks, SONET, etc. In some embodiments, the wagering game server 1306 can serve wagering games and distribute content to devices located in other casinos 1312 or at other locations on the communications network 1314.

The wagering game machines 1302 described herein can take any suitable form, such as floor standing models, handheld mobile units, bartop models, workstation-type console models, etc. Further, the wagering game machines 1302 can be primarily dedicated for use in conducting wagering games, or can include non-dedicated devices, such as mobile phones, personal digital assistants, personal computers, etc.

The e-tables 1320 described herein can include a plurality of projectors capable of presenting content at different resolutions. The e-tables 1320 can include flat projection surfaces and non-flat projection surfaces on which the projectors present player-specific and community content. The e-tables 1320 can include any of the embodiments described above.

In one embodiment, the wagering game network 1300 can include other network devices, such as accounting servers, wide area progressive servers, player tracking servers, and/or other devices suitable for use in connection with embodiments of the invention.

In some embodiments, the e-tables 1320 and wagering game servers 1306 work together such that an e-table 1320 can be operated as a thin, thick, or intermediate client. For example, one or more elements of game play may be controlled by the e-table 1320 (client) or the wagering game server 1306 (server). Game play elements can include executable game code, lookup tables, configuration files, game outcomes, audio or visual representations of the game, game assets or the like. In a thin-client example, the wagering game server 1306 can perform functions such as determining game outcome or managing assets, while the e-tables 1320 can present a graphical representation of such outcome or asset modification to the user (e.g., player). In a thick-client example, the e-tables 1320 can determine game outcomes and communicate the outcomes to the wagering game server 1306 for recording or managing a player's account.

In some embodiments, either the wagering game machines 1302 (client), the e-tables 1320 (client), or the wagering game server 1306 can provide functionality that is not directly related to game play. For example, account transactions and account rules may be managed centrally (e.g., by the wagering game server 1306) or locally (e.g., by the wagering game machine 1302, by the e-table 1320). Other functionality not directly related to game play may include power management, presentation of advertising, software or firmware updates, system quality or security checks, etc.

Any of the wagering game network components (e.g., the wagering game machines 1302, e-tables 1320, etc.) can include hardware and machine-readable media including instructions for performing the operations described herein.

General

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments of the invention, which are defined only by the appended claims. Each of the embodiments described herein are contemplated as falling within the inventive subject matter, which is set forth in the following claims.

The invention claimed is:

1. A wagering game table for presenting a wagering game, the wagering game table comprising;

a projection surface;

a first projector configured to present, at a first resolution, a first background image on the projection surface, wherein the first background image is associated with the wagering game and includes elements of the wagering game that are shared by the plurality of players, and wherein the first background image includes blank areas that are not substantially illuminated with content from the first projector;

a plurality other projectors configured to present, at a second resolution, wagering game content in the plurality of blank areas, wherein the wagering game content indicates results of the wagering game.

2. The wagering game table of claim 1, wherein the second resolution is higher than the first resolution.

3. The wagering game table of claim 1, wherein the projection surface forms a non-planar shape in which sections of the projection surface are at different heights, and wherein one or more of the other projectors have different focal lengths.

4. The wagering game table of claim 1 further comprising a second projector configured to present, at the first resolution, a second background image that combines with the first background image to form a composite background image that includes the elements of the wagering game.

5. The wagering game table of claim 1 further comprising a projection controller configured to determine locations of players at the wagering game table; and adjust locations of the plurality of blank areas on the projection surface based on the locations of the players.

6. A wagering game table for presenting a community wagering game, the wagering game table comprising:

a projection surface divided into player areas and a common area, wherein the projection surface is configured for rear projection;

a first plurality of projectors configured to project, at a first resolution, a plurality of images in the common areas, wherein the plurality of images combine together to form community content representing game elements of the community wagering game;

a second plurality of projectors configured to project, at a second resolution, player-specific content in the player areas, wherein the player-specific content in each of the player areas is associated with a player at the wagering game table, and wherein the player-specific content includes results of wagering games that are separate from the community wagering game; and a wagering game controller configured to select the plurality of images and determine results for the community wagering game.

7. The wagering game table of claim 6, wherein the projection surface forms a three-dimensional non-planar shape, and wherein the second plurality of projectors are configured to project the player-specific content onto the non-planar shape at different focal lengths.

8. The wagering game table of claim 6, wherein the first resolution is higher than the second resolution.

9. The wagering game table of claim 6, wherein community content and player specific-content are rendered at 1920×1080 resolution.

10. The wagering game table of claim 6, wherein community content includes markings indicating where to place, as part of the community wagering game, physical game pieces on the projection surface.

11. A method for dynamically rearranging player areas on a projection surface of an electronic wagering game table, the method comprising:

projecting, at a first resolution, a first group of player-specific images in player areas of the projection surface, wherein the player areas reside at a first group of locations on the projection surface, and wherein the player-specific images in each player area are associated with one of a plurality of players at the electronic wagering game table;

projecting, at a second resolution, a first group of community images in a community area of the projection surface, wherein the community images are associated with all of the plurality of players at the electronic wagering game table;

processing input associated with the player and community areas;

initiating, based on the input, a community wagering game;

resizing the player areas;

moving the player areas to reside at a second group of locations on the projection surface;

resizing the common area on the projection surface;

projecting, at the second resolution, on the projection surface in the common area, a second group of community images that indicate results of the community wagering game;

projecting, on the projection surface, at the first resolution, in the player areas residing at the second group of locations, a second group of player-specific images indicating player account information resulting from the community wagering game.

12. The method of claim 11, wherein the resizing of the common area includes enlarging the common area.

13. The method of claim 11, wherein the resizing of the player areas includes shrinking the player areas.

14. The method of claim 11, wherein the first resolution is higher than the second resolution.

15. The method of claim 11, wherein the community wagering game includes tangible game elements used in conjunction with graphical game elements.

16. A method for presenting a wagering game on an electronic wagering game table, the method comprising:

projecting, using a plurality of projectors configured at a first display resolution, community content on a first projection surface of the electronic wagering game table, wherein the community content includes markings indicating areas in which tangible game pieces are played, wherein the tangible game pieces are used in playing the wagering game;

projecting, using a plurality of projections configured at a second resolution, player-specific content on other projection surfaces of the electronic wagering game table, wherein the other projection surfaces correspond to player positions at the electronic wagering game table, and wherein the player-specific content indicates wagers placed by each player at the electronic wagering game table;

determining results for the wagering game;

projecting, using the plurality of projections configured at the second resolution, additional player-specific content on the other projection surfaces, wherein the additional player-specific content indicates results of the wagering game and financial information resulting from the wagering game.

17. The method of claim 16, wherein the other projection surfaces are oriented in a different plane than the first projection surface, and wherein the other projection surfaces are retained by bezels.

18. The method of claim 16, wherein the tangible game pieces include playing cards.

19. The method of claim 16 further including:

receiving input about the tangible game pieces.

20. The method of claim 16, wherein the first resolution is lower than the second resolution.

21. An apparatus capable of dynamically rearranging player areas on a projection surface of an electronic wagering game table, the method comprising:

means for projecting, at a first resolution, a first group of player-specific images in player areas of the projection surface, wherein the player areas reside at a first group of locations on the projection surface, and wherein the player-specific images are associated with players at the electronic wagering game table;

means for projecting, at a second resolution, a first group of community images in a community area of the projection surface, wherein the community images are associated with a plurality of players at the electronic wagering game table;

means for processing input associated with the player and community areas;

means for initiating, based on the input, a community wagering game;

means for resizing the player areas;

means for moving the player areas to reside at a second group of locations on the projection surface;

means for resizing the common area on the projection surface;

means for projecting, at the second resolution, on the projection surface in the common area, a second group of community images that indicate results of the community wagering game;

means for projecting, at the first resolution, on the projection surface in the player areas residing at the second group of locations, a second group of player-specific images indicating player account updates resulting from the community wagering game.

22. The apparatus of claim 21, wherein the means for resizing of the common area includes enlarging the common area.

23. The apparatus of claim 21, wherein the means for resizing of the player areas includes shrinking the player areas.

24. The apparatus of claim 21, wherein the first resolution is higher than the second resolution.

25. The apparatus of claim 21, wherein the community wagering game includes tangible game elements used in conjunction with graphical game elements.

* * * * *